United States Patent [19]

Wang

[11] 4,307,763

[45] Dec. 29, 1981

[54] TONER CONTAINER

[75] Inventor: James P. Wang, Lexington, Ky.

[73] Assignee: International Business Machines Corporation, Armonk, N.Y.

[21] Appl. No.: 98,575

[22] Filed: Nov. 29, 1979

[51] Int. Cl.[3] ..... B65B 3/06

[52] U.S. Cl. ..... 141/364; 222/505; 222/510; 222/544; 141/366; 138/89; 251/89

[58] Field of Search ..... 141/350, 351, 363, 364, 141/365, 366, 375, 352, 353, 354, 355, 349; 222/510, 544, 505; 251/89; 138/89

[56] References Cited

U.S. PATENT DOCUMENTS

| | | | |
|---|---|---|---|
| 2,188,402 | 1/1940 | Feis | 141/375 |
| 2,342,215 | 2/1944 | Perelson . | |
| 2,849,156 | 8/1958 | Mansted . | |
| 2,899,106 | 8/1959 | Weinert . | |
| 3,397,820 | 8/1968 | Smith . | |
| 3,512,524 | 5/1970 | Drewe . | |
| 3,596,801 | 8/1971 | Barnack . | |
| 3,599,682 | 8/1971 | Altmann . | |
| 3,670,728 | 6/1972 | Dabney . | |
| 3,838,794 | 10/1974 | Cogley et al. . | |
| 3,974,942 | 8/1976 | Gray et al. . | |
| 4,146,070 | 3/1979 | Angarova et al. | 141/349 |

FOREIGN PATENT DOCUMENTS

| | | |
|---|---|---|
| 1189147 | 4/1970 | United Kingdom . |
| 1272272 | 4/1972 | United Kingdom . |
| 1486885 | 9/1977 | United Kingdom . |

*Primary Examiner*—Houston S. Bell, Jr.
*Attorney, Agent, or Firm*—John W. Girvin, Jr.

[57] ABSTRACT

A toner container includes a displaceable member located within the container and attached to one end of a flexible membrane utilized to seal the container closed. A bellows member also forms part of the container. Once the container is inserted into the copy machine in a sealed condition, operator initiated pressure upon an outer wall of the container causes the bellows member to collapse and further causes the displaceable member to move downward carrying with it the membrane member. As the membrane member is thus deflected, the seal of the membrane member to the toner container is broken allowing the contents of the container to escape into the copy machine. A safety mechanism is utilized with the container to prevent accidental operation of the displaceable member during shipment or handling.

15 Claims, 12 Drawing Figures

TONER CONTAINER

BRIEF BACKGROUND OF THE INVENTION

1. Field of Invention

This invention relates to a powder container and more particularly, to a toner container having an enclosed container opening system and useable in an office copy machine.

2. Description of the Prior Art

Office copy machines typically employ a member which is electrostatically charged with an image pattern corresponding to a document being copied. The electrostatically charged image is dusted with a fine toner powder which is either transfered to a sheet of paper or the like or retained on the member. The toner powder is then fixed, typically by heating it to its melting point. The toner powder consists of finely divided plastic particles averaging approximately 10 microns in size.

Since the toner particles are consumed during the copying process, they must be replenished in the copy machine. In prior art copy machines, replenishment was accomplished by pouring toner particles into the toner receptacle of the copy machine. This operation often caused spillage of the toner particles in the machine ambience was a distasteful operation to operators of the machine. Various toner packages were thereafter developed which are inserted adjacent the toner receptacle. The operator then removes a lid from the toner container allowing the toner to drop into the toner receptacle. This operation is cleaner than that previously employed but nevertheless, toner still adheres to the lid as it is withdrawn from the container causing the operator's hands to become soiled and/or spilling toner into the machine. Further, the toner package cannot be tightly clamped to the toner receptacle because the lid must be removed from an area between the toner package and the toner receptacle.

Various liquid dispensing containers have been developed which incorporate a knife-like member within the container. Upon actuation, the knife-like member pierces a membrane envelope allowing the liquid to escape from the container. Such knife-like members present a safety hazard when handled by operators and further cause problems in dispensing the entire contents of the container when the container contains powder particles.

SUMMARY

In order to overcome the aforenoted shortcomings of the prior art and to provide a toner container which can readily dispense its contents into the toner receptacle of a copy machine without spillage, the toner container of the present invention includes a displaceable member located within the container and attached at one end to a flexible membrane utilized to seal the container closed. Upon operator initiated displacement of the displaceable member, the seal of the membrane is broken allowing the contents of the container to be distributed into the toner receptacle. The membrane remains attached to the displaceable member preventing it from contaminating the machine's toner supply. A safety mechanism is utilized with the container to prevent accidental operation of the displaceable member during shipment or handling.

Accordingly, it is the principle object of the invention to provide a powder container which can be readily operated to dispense its contents into a powder receptacle without spillage.

It is a further object of the invention to provide a toner container for a copy machine which can readily dispense its contents into a toner receptacle upon operator pressure on the outside of the container wall.

The foregoing objects, features and advantages of the invention will be apparent from the following more particular description of the preferred embodiments of the invention as illustrated in the accompanying drawings.

IN THE DRAWINGS

DETAILED DESCRIPTION

Figure 1:
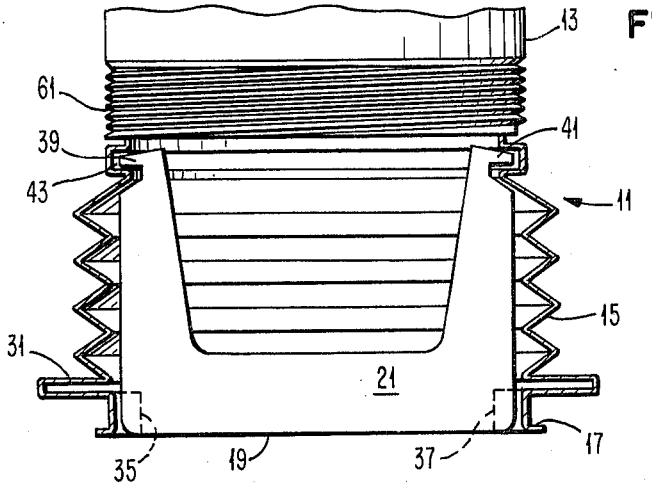
FIG. 1 is a cross-section view of a first embodiment of the toner container of the present invention.
Figure 2:
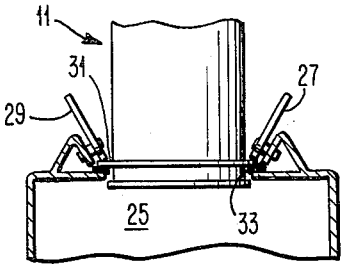
FIG. 2 is a side view partly in section of the toner container of FIG. 1 and a portion of a toner receptacle of a copy machine.

Referring now to the drawing and more particularly to FIG. 1 thereof, a cross-section view of a first embodiment of the toner container of the present invention is depicted. The toner container 11 includes a rigid cavity defining member 13, a bellows member 15, an opening defining member 17, and a membrane member 19. These members collectively define a completely enclosed cavity wherein toner particles (not shown) are stored. A displaceable member 21 is located within the closed cavity and is fixedly attached to the membrane member 19.

With reference to FIGS. 1–4, the toner container 11 is placed over a toner receptacle 25 of a copier machine. Clamping members 27 and 29 located on the toner receptacle 25 pivot over the flange 31 of the toner container 11 forcing it downward against an annular shaped gasket 33 of the toner receptacle 25. The flange 31 and gasket 33 thus form a tight seal to prevent the escape of toner particles into the copy machine ambience. It is noted that this seal is a tight one since it is no longer necessary to remove the membrane member through the seal as was previously done.

Once the toner container 11 is inserted in the toner receptacle 25, the operator causes the displaceable member 21 to move in a downward direction as will be described hereafter. This downward motion causes the membrane member 19 to separate from the opening defining member 17 allowing the toner contents of the toner container 11 to drop into the toner receptacle 25.

Guide members 35 and 37 maintain the movement of the displaceable member within a verticle plane. The tabs 39 and 41 of the displaceable member 21 snap within an annularly shaped cavity 43 of the rigid member 13 during assembly of the container. Thus, subsequent downward motion of the rigid member 13 causes the rigid member 13 to act upon the tabs 39 and 41 thereby causing the displaceable member 21 to move downward. During this downward motion, the bellows member 15 collapses allowing both the rigid member 13 and the displaceable member 21 to move relative to the opening defining member 17.

Figure 4:
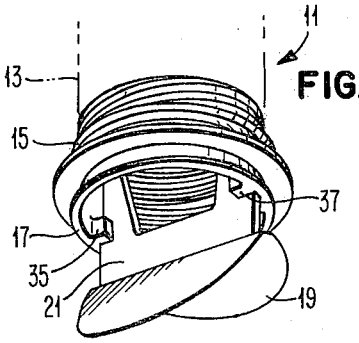
Figure 6:
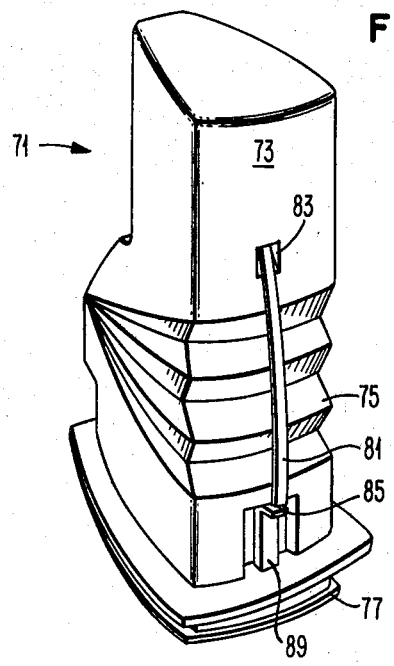
FIGS. 6 and 7 are perspective views of a second embodiment of the toner container of the present invention.
Figure 7:
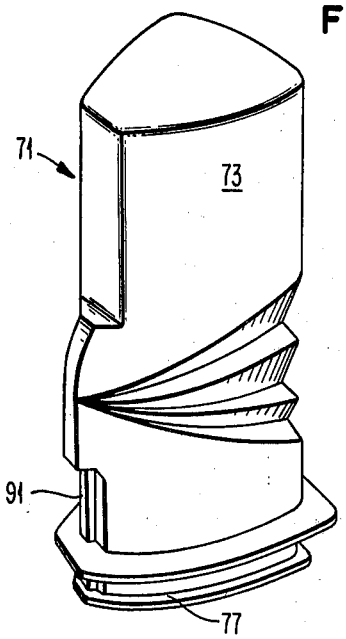
Figure 8:
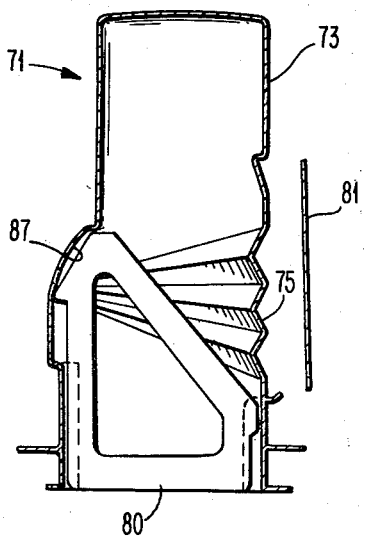
FIGS. 8 and 9 are cross-section views of the toner container of FIGS. 6 and 7.
Figure 9:
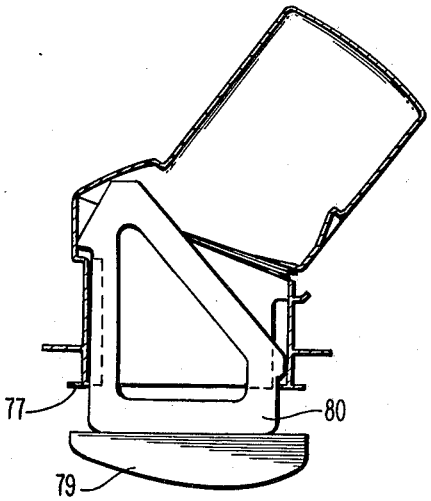

The membrane member 19 must be flexible so as to deflect in a downward direction as depicted in FIG. 4 under the weight of escaping toner thereby allowing all of the contents of the container 11 to escape. The membrane member must also shear away from the opening defining member 17 without being punctured by the displaceable member 21. The membrane member must also be readily attached to the opening defining member 17 and to the displaceable member 21 during assembly of the container. Materials which meet these requirements include Tyvek* and co-extruded Nylon*/Surlyn* films. A fifteen mil thick Tyvek* film provides the proper amount of tear resistance while maintaining a good degree of flexibility. Retort materials manufactured by various manufacturers for food packaging all consisting of bioriented laminated extruded films also provide proper membrane material. The selected material is coated with a hot melt adhesive to facilitate heat sealing thereof to the opening defining member 17 and the displaceable member 21.

(*trademarks of E. I. du Pont de Nemours & Co.)

The opening defining member 17 includes a lip surface 45 for establishing a sealing relationship with the membrane member 19. As noted in FIG. 3, the end portion 46 of the displaceable member 21 which is heat sealed to the opposite side of the membrane member 19 is rectangular in cross-section. The membrane member 19 is caused to first peel away from the lip surface 45 of the opening defining member 17 at areas adjacent the short sides 47 and 49 of the rectangularly shaped displaceable member 21. Further downward motion causes the seal to progressively tear away until the membrane member 19 becomes entirely separated from the opening defining member 17. The weight of the contained toner forces the membrane member 19 to assume the position depicted in FIG. 4 upon completion of the downward motion of the displaceable member 21.

Figure 5:
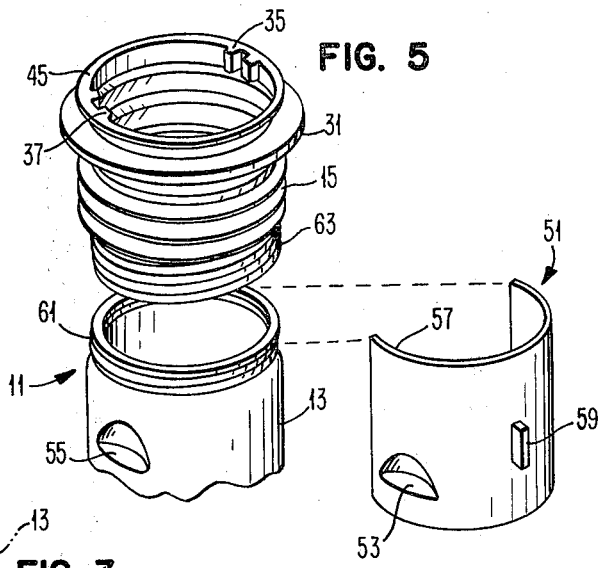
FIG. 5 is an exploded perspective view of the toner container of FIG. 1 and a safety device therefore.
Figure 3:
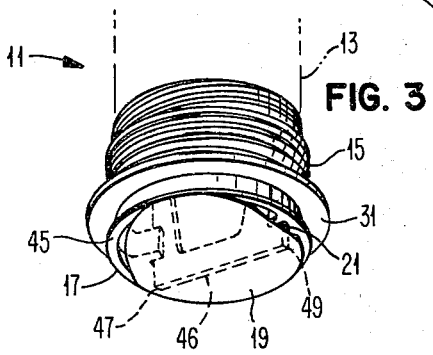
FIGS. 3 and 4 are bottom perspective views of the toner container of FIG. 1 during operation.

Referring now to FIG. 5 of the drawing, an exploded perspective view of the toner container of FIGS. 1–4 and a safety device therefore is depicted. The safety device 51 is utilized to restrain the collapse of the bellows member 15 and hence the movement of the rigid member 13 during shipment and handling of the container 11. The safety device 51 is removed from the container 11 immediately prior to inserting the container in the toner receptacle 25. The safety device 51 has a camming cavity 53 and a second camming cavity (not shown) which snap over a corresponding camming projection 55 and a camming projection (not shown) formed in the rigid member 13 of the container 11. The edge 52 of the safety device 51 fits against the flange 31 of the opening defining member 17 and thus maintains a rigid connection between the rigid member 13 and the opening defining member 31 preventing collapse of the bellows member 15. A projection 59 facilitates operator removal of the safety device 51.

The rigid member 13 has a threaded section 61 which mates with a corresponding threaded section 63 of the bellows member 15 facilitating ready assembly of the two members. Additionally, it may be desired to ship toner within the rigid member 13 by placing a normal jar cap lid (not shown) over the rigid member 13. Upon receipt, the jar cap lid can be removed and the bellows member can at that time be attached.

Referring now to FIGS. 6–9 of the drawing, a second embodiment of the toner container of the present invention is depicted.

The toner container 71 includes a rigid member 73, a bellows member 75, an opening defining member 77, a membrane member 79, a displaceable member 80 and a safety member 81. The rigid member 73, bellows member 75 and opening defining member 77 may be made of a single blow molded plastic part. Polyethylene and polypropylene materials may be utilized to form this part providing the requisite degree of rigidity and flexibility. The displaceable member 80 and the safety member 81 may be made of a more rigid plastic such as polyvinylchloride.

The safety member 81 is inserted in a wedge shaped opening 83 and on a upwardly bent lip 85 preventing accidental collapse of the bellows member 75. Upon removal of the safety member 81 and placement of the cartridge in the copier machine in the same manner as described with respect to the embodiment of FIG. 1, the operator may effect opening of the container 71 by pulling the upper portion of the rigid member 73 toward the right as viewed in FIGS. 8 and 9. This causes the surface 87 to act upon the displaceable member 80 causing it to move downward within guide slots 89 and 91. Such downward motion causes the membrane member 79 secured to the displaceable member 80 to become displaced from the opening defining member 77 from which it was previously secured. This action takes place in much the same manner as described heretofore with the embodiment described in FIG. 1.

Figure 10:
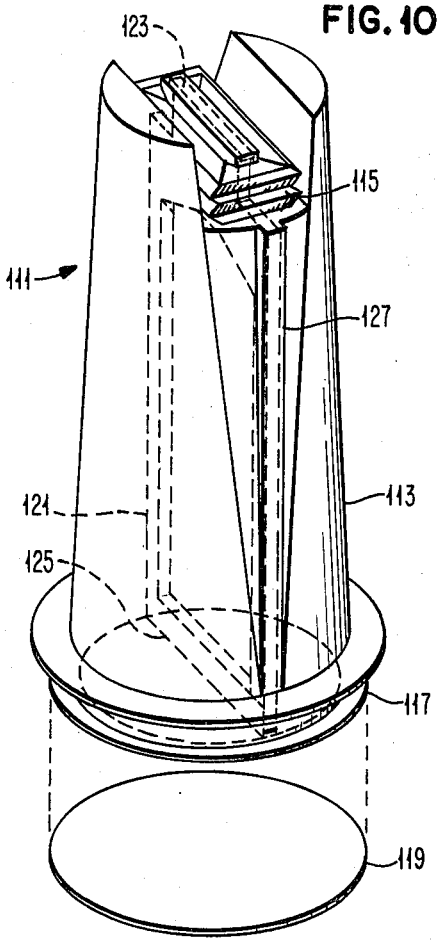
FIG. 10 is a perspective view of a third embodiment of the toner container of the present invention.
Figure 11:
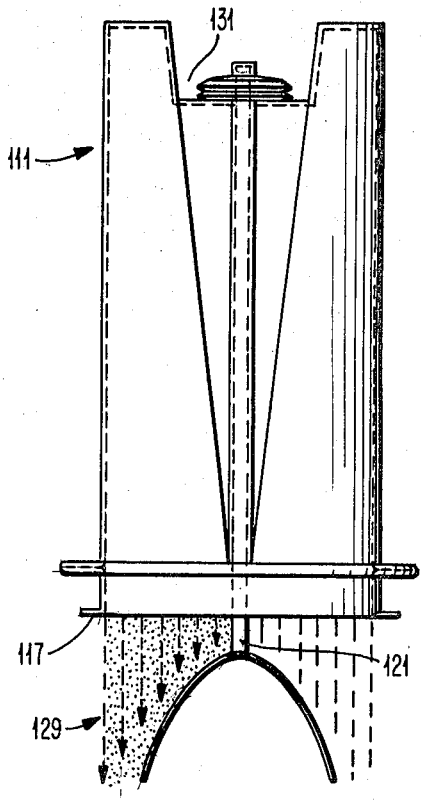
FIG. 11 is a side view of the toner container of FIG. 10.
Figure 12:
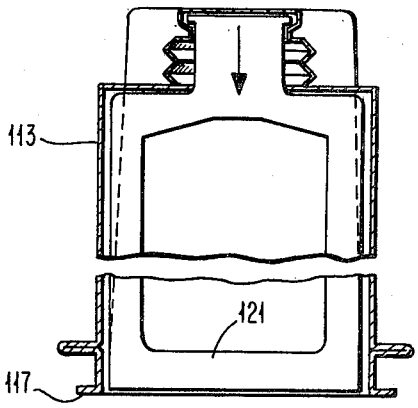
FIG. 12 is a cross-section view of the toner container of FIG. 10.

Referring now to FIGS. 10–12, a third embodiment of the toner container of the present invention is depicted. The toner container 111 includes the rigid member 113, a bellows member 115, an opening defining member 117, a membrane member 119 and a displaceable member 121. The upper end 123 of the displaceable member 121 is attached to the bellows member 115 while its lower end 125 is attached to membrane member 119. As depicted in FIG. 11, operator initiated downward motion of the bellows member 115 causes it to collapse and effects corresponding downward motion of the displaceable member 121. The displaceable member is restrained to move in a vertical plane by the guide 127 and a corresponding guide (not shown) formed in the rigid member 113. The downward motion of the displaceable member 121 effects the severing of the seal between the membrane member 119 and the opening defining member 117 in the same manner as that described with respect to the embodment of FIG. 1. The toner particles 129 thus fall out in a downward direction into the copier machine.

The bellows member 115 is located within a U-shaped cavity 131 of the rigid member 113. This prevents accidental collapse of the bellows member during shipment of handling and thus forms a safety device.

One of the advantages of the toner container of the present invention is that all of the contents of the toner can be delivered to the toner receptacle of the copier machine. Toner which clings to the membrane member 119 is removed by merely tapping the toner container 111.

While a flange and gasket system of attaching the toner container to the copy machine has been described, it is, of course, recognized that various means to attach the container to the machine could be employed. For example, a threaded connection could be utilized causing the lip surface 45 to be moved inward to clear the outer periphery of the opening defining member 17. Also, various shaped containers could be employed. Further, the rigid cavity defining member 13 could be formed coextensively with the bellows member or could be flexible in the form of a bag. It is only necessary that it and the bellows member allow flexing of the container to allow displacement of the displaceable member.

While the invention has been particularly shown and described with reference to the preferred embodiments thereof, it will be understood by those skilled in the art that the foregoing and other changes in form and details may be made therein without departing from the spirit and scope of the invention.

What is claimed is:

1. An enclosed container for powder material comprising:

a cavity defining member;

an opening defining member for defining an opening in said container;

a flexible membrane member connected to said opening defining member for sealing said opening;

said cavity defining member, said opening defining member and said membrane member collectively defining an enclosed cavity for containing said powder;

a displaceable member contained completely within said cavity and proximate to said opening and having an end portion connected to said flexible membrane member and displaceable relative to said opening defining member, said displaceable member moving outward through said opening upon displacement thereof to dislocate said opening defining member allowing the powder contents of said container to be removed through said opening defining member;

a movement allowing member for permitting movement of said displaceable member relative to said opening defining member.

2. The enclosed container for powder material set forth in claim 1 wherein said movement allowing member further defines the cavity of said container.

3. The enclosed continer set forth in claim 2 wherein said movement allowing member is connected to said cavity defining member and further permits movement of said cavity defining member relative to said opening defining member, said cavity defining member acting upon said displaceable member effecting displacement of said displaceable member.

4. The enclosed container set forth in claim 2 wherein said movement allowing member is connected to the cavity defining member and to the displaceable member, movement of the movement allowing member relative to the cavity defining member effecting displacement of said displaceable member.

5. The enclosed container set forth in claims 3 or 4 wherein said movement allowing member is a bellows member.

6. The enclosed container set forth in claim 3 further including a removable motion restraining member attached to the container for preventing movement of the cavity defining member and wherein said cavity defining member is a rigid member.

7. A toner container adapted to dispense toner to a toner receptacle of a copy machine following insertion into the toner receptacle, the toner container comprising:

a rigid cavity defining member;

an opening defining member for defining an opening in the container;

a flexible membrane member connected to the opening defining member for sealing the opening;

a movement allowing member connected to the rigid cavity defining member for moving relative to the opening defining member;

a displaceable member contained within the container interior proximate to the opening and having an end portion connected to the flexible membrane member and displaceable upon movement of the movement allowing member, the displaceable member moving outward through the opening upon displacement thereof to dislocate the membrane member from the sealing connection with the opening defining member thereby allowing the toner contents of the toner container to fall through the opening defining member into the toner receptacle.

8. The toner container set forth in claim 7 wherein the container is circular in cross-section at the opening defining member and wherein the end portion of the displaceable member is rectangular in cross-section where connected to the flexible membrane member causing the flexible membrane member to firstly break contact from the opening defining member at areas adjacent the short sides of the rectangular shape upon displacement of the displaceable member.

9. The toner container set forth in claim 7 wherein the movement allowing member forms a part of the cavity of the container.

10. The toner container as set forth in claim 7 wherein the movement allowing member is a bellows member.

11. The toner container set forth in claim 10 wherein the movement allowing member is connected to the displaceable member for effecting displacement thereof upon movement of the movement allowing member.

12. The toner container set forth in claim 10 wherein the rigid cavity defining member is connected to the displaceable member for effecting displacement thereof upon movement thereof.

13. The toner container set forth in claim 12 further including a safety device to prevent accidental displacement of said displaceable member.

14. The toner container set forth in claim 13 wherein said safety device includes a removable motion restraining member attached to the toner container for preventing the movement of the cavity defining member.

15. The toner container set forth in claim 7 further including a sealing member connected to the opening defining member for coacting with the toner receptacle to form a tight seal between the toner container and the toner receptacle.

* * * * *